US008998337B2

(12) United States Patent
Miyamoto

(10) Patent No.: US 8,998,337 B2
(45) Date of Patent: Apr. 7, 2015

(54) BACKREST CHAIR, AND A SHEET MATERIAL FOR USE THEREON

(76) Inventor: Seizou Miyamoto, Osakasayama (JP)

( * ) Notice: Subject to any disclaimer, the term of this patent is extended or adjusted under 35 U.S.C. 154(b) by 55 days.

(21) Appl. No.: 13/704,237

(22) PCT Filed: Aug. 30, 2011

(86) PCT No.: PCT/JP2011/004828
§ 371 (c)(1),
(2), (4) Date: Dec. 13, 2012

(87) PCT Pub. No.: WO2012/042742
PCT Pub. Date: Apr. 5, 2012

(65) Prior Publication Data

US 2013/0099537 A1 Apr. 25, 2013

(30) Foreign Application Priority Data

Sep. 27, 2010 (JP) ..... 2010-215433

(51) Int. Cl.
*A47C 7/02* (2006.01)
*A47C 7/46* (2006.01)
(Continued)

(52) U.S. Cl.
CPC . *A47C 7/46* (2013.01); *A47C 31/11* (2013.01); *A47C 7/445* (2013.01); *A47C 3/12* (2013.01)

(58) Field of Classification Search
CPC ..... A47C 31/11; A47C 7/021; A47C 7/445
USPC ..... 297/411.41, 452.13, 452.14, 452.15, 297/440.12, 404, 452.34
See application file for complete search history.

(56) References Cited

U.S. PATENT DOCUMENTS 2,689,602 A * 9/1954 Morgan ..... 297/45
4,290,643 A * 9/1981 Logan, 3rd. ..... 297/16.2
(Continued)

FOREIGN PATENT DOCUMENTS

JP 6-503237 A 4/1994
JP 10-327965 A 12/1998
(Continued)

OTHER PUBLICATIONS

International Search Report for the Application No. PCT/JP2011/004828 mailed Oct. 4, 2011.
(Continued)

*Primary Examiner* — David R Dunn
*Assistant Examiner* — Jody Giacoman
(74) *Attorney, Agent, or Firm* — Cheng Law Group, PLLC

(57) ABSTRACT

[Problem] To provide a comfortable backrest chair.
[Solution] A shape retaining material is formed to have radial cores 12 distributed and radially extending upward from a base plate adjacent a cut hole 4 to be fitted on a chair support frame, and a first and a second reinforcing cores 13 and 14 arranged adjacent the base plate of the radial cores 12. A core sheet is formed by attaching a first, a second and a third mesh sheets 9 to the shape retaining material. A chair sheet material is formed by attaching a first and a second buffer sheets 15 and 16 and an outer surface side buffer sheet 7 to the core sheet. A backrest portion of the chair sheet material is constructed to have a larger right and left width than the breadth of a seated person's shoulders, and when the load of the seated person is applied, right and left opposite ends of the backrest portion can be displaced in directions to approach each other due to elasticity of the core sheet. An upper extending part of the backrest portion is capable of supporting the head of the seated person, and bending to move further rearward than the backrest portion due to the elasticity of the core sheet.

10 Claims, 12 Drawing Sheets

(51) Int. Cl.

| | |
|---|---|
| ***A47C 31/11*** | (2006.01) |
| ***A47C 7/44*** | (2006.01) |
| ***A47C 3/12*** | (2006.01) |

(56) References Cited

U.S. PATENT DOCUMENTS

| | | | | |
|---|---|---|---|---|
| 4,993,164 | A * | 2/1991 | Jacobsen | 33/561.3 |
| 5,403,067 | A | 4/1995 | Rajaratnam | |
| 5,934,757 | A * | 8/1999 | Smith | 297/452.13 |
| 2008/0315660 | A1* | 12/2008 | Spicer | 297/452.13 |
| 2011/0204694 | A1 | 8/2011 | Igarashi et al. | |
| 2011/0278899 | A1* | 11/2011 | Schouten et al. | 297/440.12 |

FOREIGN PATENT DOCUMENTS

| | | | |
|---|---|---|---|
| JP | 2000-50998 | A | 2/2000 |
| JP | 2002-125804 | A | 5/2002 |
| JP | 2003-10001 | A | 1/2003 |
| JP | 2010-104464 | A | 5/2010 |
| WO | WO-2010/050204 | | 5/2010 |

OTHER PUBLICATIONS

The First Office Action for the Application No. 201180046643.4 from The State Intellectual Property Office of the People's Republic of China dated Nov. 13, 2014.

* cited by examiner (a)

(b)

BACKREST CHAIR, AND A SHEET MATERIAL FOR USE THEREON

TECHNICAL FIELD

This invention relates to a backrest chair, and a sheet material for use in manufacture of the backrest chair.

BACKGROUND ART

The following backrest chairs are conventionally known:

(1) First Conventional Example

A chair includes a pair of approximately inverted U-shape leg frames with front legs and back legs extending as integral parts thereof, intermediate connecting members connecting the respective leg frames at intermediate parts between the front legs and back legs, a front leg connecting member connected substantially at right angle to a lower end of the front leg of each leg frame, a back leg connecting member connected substantially at right angle to a lower end of the back leg of each leg frame, and a seat plate fixed to the intermediate connecting members from above between the intermediate parts the respective leg frames.

Bases are fixed to the intermediate connecting members from below between the intermediate parts of the respective leg frames, and a pair of approximately L-shaped back frames are provided on these bases. These back frames have back receivers extending upward from ends of the bases adjacent the back legs, and upper parts of the back receivers are interconnected by a back plate.

The pair of back frames and the back plate constitute a backrest. Each leg frame, each front leg connecting member, each back leg connecting member and each back frame are formed of square pipe made of an aluminum alloy and having a square section perpendicular to its axis (see Patent Document 1).

(2) Second Conventional Example

A chair is constructed of a backrest portion and a seat portion supported swivelable on a rotary shaft of a base leg.

The backrest portion includes a backrest lower frame, a backrest upper frame, and a spread member extending between these two frames through elastic members, and the two frames are rotatably attached to a horizontal rotary shaft provided in brackets of link elements (see Patent Document 2).

(3) Third Conventional Example

A base frame member shallow and generally box-shaped as seen in plan is attached to upper ends of leg struts through a backward slide mechanism which self-returns forward by a spring.

A front end of a support frame member is pivotally attached by a horizontal axis to an intermediate part of the base frame member. A region rearward of a pivotal point of the support frame member is slightly inclined upward or extends generally parallel to a seat surface, and is raised vertically from a rear end through a curved portion. The raised portion acts as a backrest support portion.

The support frame member has a receiving and supporting member disposed intermediate between a front end and the rear end thereof for receiving and supporting a rear portion of a seat.

The support frame member has a torsion spring with a coil portion thereof mounted on the horizontal axis. A front end of this spring is hooked and supported by a forward spring support portion provided on the base frame member, and a rear end of this spring by a rearward spring support portion provided on the support frame member, respectively, whereby the spring constantly biases the support frame member counterclockwise about the horizontal axis.

The base frame member has a support piece member pivotally attached to the front end thereof through the horizontal axis and formed of an approximately elliptical link material. A support plate which serves as a receiving and supporting member for a seat front part is placed on an upper part of the support piece member to be rockable fore and aft through a pin hinge. A seat inner shell is placed on and fixed to receiving and supporting supports at the seat front part and seat rear part.

A rear portion of the seat inner shell is formed to be a curved rising portion shaped to follow the curved portion formed at a boundary portion of the raised portion from the rear portion of the support frame member, and to its lower surface a lower part of a backrest outer shell (back outer shell) is coupled.

The back inner shell is spread on a front surface of the raised portion of the support frame member, with part of a lower end overlapping or not overlapping an upper end the curved portion of the seat inner shell. The back outer shell is applied to a back surface of the raised portion of the support frame member.

The support frame member has a portion thereof from the rear end to the raised portion formed of a metal panel having a continuous corrugated section. This construction inhibits the raised portion from bending in the right backward direction, but allows it to bend obliquely backward easily.

When a user sits on the seat surface and leans on the backrest, the load reclines the raised portion of the support frame member, the back inner shell and the back outer shell all together (see Patent Document 3).

PRIOR ART DOCUMENTS

Patent Documents

[Patent Document 1] Unexamined Patent Publication No. 2002-125804 (see FIGS. 1 and 2)

[Patent Document 2] Unexamined Patent Publication No. 2003-10001 (see to FIGS. 1 and 2)

[Patent Document 3] Unexamined Patent Publication H10-327965 (see FIGS. 1, 3 and 4)

SUMMARY OF THE INVENTION

Problem to be Solved by the Invention

As noted above, even though the conventional backrest chairs have cushioning materials attached to portions of contact with the backs of users, the entire backrests are constructed of highly rigid frame members of large strength, like the back frames of the first conventional example, the backrest upper frame of the second conventional example, and the raised portion of the support frame member, the back inner shell and the back outer shell of the third conventional example. Although the backrests are displaceable, the lower end regions of the frame members are rockably attached to the seat portions to return to an upstanding position by spring members. When a seated person applies a load to the backrest, the entire backrest makes rocking movement. Such construction cannot support the seated person in a way to wrap around the person's body.

In a known chair which can support the head with an upper part of a backrest, the upper part of the backrest extends as an integral part, or a headrest is detachable attached. In such a construction, a head support portion and a backrest portion are only integrated and displaced. When a load is applied by leaning only the head backward relative to the shoulders, it is impossible to displace only the head support portion. This simply results in a strained state hardly providing a feeling of comfort.

This invention has been made having regard to the state of the art noted above, and its object is to provide a backrest chair which can afford a feeling of comfort. One object is, while supporting the head of a seated person, to enable the seated person to lean only the head backward relative to the shoulders. Another object is to support a seated person in a way to wrap around the person's body when the seated person applies a load to the backrest. A further object is, while supporting a seated person in a way to wrap around the person's body when the seated person applies a load to the backrest, to enable the seated person to lean only the head backward relative to the shoulders.

A different object is to provide a chair sheet material which is easy to handle and can be manufactured at low cost when manufacturing a backrest chair which can afford a feeling of comfort as noted above. A further different object is to provide a chair sheet material which simplifies attachment to a chair support frame, and can facilitate assembly of a chair.

Means for Solving the Problem

A backrest chair of this invention is characterized in that a core sheet is formed by attaching a shape retaining material capable of elastic bending deformation to mesh sheets capable of elastic bending deformation, to have an elastic resilience for assuming a backrest shape in a natural state and to be elastically displaceable while maintaining a backrest state by a stretching force in a use situation; that a chair sheet material is formed by providing a buffer sheet to cover a surface of the core sheet which is in the use situation on a back side of a seated person in a seated position; that an upper part of a backrest portion of the chair sheet material is extended to be capable of supporting the head of the seated person, and when a load of the head of the seated person is applied to the extended part, the extended part can bend and move further rearward than the backrest portion of the chair sheet material due to elasticity of the core sheet; and that the chair sheet material is attached to a chair support frame lower than a seat surface in a state of positioning the core sheet and the buffer sheet on the back and the rear surface of the head of the seated person.

Here, "elastically displaceable while maintaining a backrest state" means elastically displaceable, when a load is applied from the seated person's back to the backrest portion of the chair sheet material, from a backrest shape in a natural state while the seated person's back contacts the backrest portion of the chair sheet material (this applies also to the same term used hereinafter).

According to the backrest chair of this invention, the core sheet is formed of mesh sheets and a shape retaining material both capable of elastic bending deformation, the chair sheet material is formed of the core sheet and a buffer sheet, and the chair sheet material is attached to the chair support frame lower than the seat surface to make the backrest chair. This construction assumes a backrest shape in a natural state, and in a use situation, that is when a seated person applies a load to the backrest, on the other hand, can make elastic displacement while maintaining a backrest state due to the mesh sheets and shape retaining material and a mutual stretching force. Moreover, the extended part extended upward of the backrest portion of the chair sheet material for supporting the head of the seated person, when the load of the head of the seated person is applied, can bend and move further rearward than the backrest portion of the chair sheet material due to the elasticity of the core sheet. Thus, while supporting the head of the seated person, only the head can be made to lean back relative to the shoulders.

Therefore, the entire backrest is not formed of frame members of high rigidity with large strength as in the prior art. When the seated person applies a load, the backrest is elastically displaced while maintaining a backrest state, and when the load of the head of the seated person is applied, the extended part is bent further rearward than the backrest portion of the chair sheet material. This can support the entire body of the seated person softly, and allow only the head to lean back relative to the shoulders while supporting the head of the seated person with the extended part. Thus, the comfortable backrest chair can be provided, which allows the seated person to sit in a relaxed way, with the entire body including the head supported softly.

A backrest chair of this invention is constructed such that a core sheet is formed by attaching a shape retaining material capable of elastic bending deformation to mesh sheets capable of elastic bending deformation, to have an elastic resilience for assuming a backrest shape in a natural state and to be elastically displaceable while maintaining a backrest state by a stretching force in a use situation; that a chair sheet material is formed by providing a buffer sheet to cover a surface of the core sheet which is in the use situation on a back side of a seated person in a seated position; that a right and left width of a backrest portion of the chair sheet material is made larger than a breadth of the seated person's shoulders, and when a load of the seated person is applied to the backrest portion of the chair sheet material, right and left opposite ends of the backrest portion of the chair sheet material can be displaced in directions to approach each other due to elasticity of the core sheet; and that the chair sheet material is attached to a chair support frame lower than a seat surface in a state of positioning the core sheet and the buffer sheet on the back and the rear surface of the head of the seated person.

According to the backrest chair of this invention, the core sheet is formed of mesh sheets and a shape retaining material both capable of elastic bending deformation, the chair sheet material is formed of the core sheet and a buffer sheet, and the chair sheet material is attached to the chair support frame lower than the seat surface to make the backrest chair. This construction assumes a backrest shape in a natural state, and in a use situation, that is when a seated person applies a load to the backrest, on the other hand, can make elastic displacement while maintaining a backrest state due to the mesh sheets and shape retaining material per se and a mutual stretching force. Moreover, the right and left width of the backrest portion of the chair sheet material is made larger than the breadth of the seated person's shoulders, and when the load of the seated person is applied to the backrest portion of the chair sheet material, right and left opposite ends of the backrest portion of the chair sheet material can be displaced in directions to approach each other due to the elasticity of the core sheet. This can support, in a way to wrap around, the body of the seated person.

Therefore, the entire backrest is not formed of frame members of high rigidity with large strength as in the prior art.

When the seated person applies a load, the backrest is elastically displaced while maintaining a backrest state, and when the load of the seated person is applied to the backrest portion of the chair sheet material, the right and left opposite ends of the backrest portion of the chair sheet material are displaced in directions to approach each other due to the elasticity of the core sheet. This can softly support, in a way to wrap around, the entire body of the seated person. Thus, the comfortable backrest chair can be provided, which allows the seated person to sit in a relaxed way, and can softly support, in a way to wrap around, the entire body of the seated person.

In the backrest chair of the invention described above, it is preferred that an upper part of the backrest portion of the chair sheet material is extended to be capable of supporting the head of the seated person, and when a load of the head of the seated person is applied to the extended part, the extended part can bend and move further rearward than the backrest portion of the chair sheet material due to the elasticity of the core sheet.

With this construction, when the load of the head of the seated person is applied, the extended part is bent further rearward than the backrest portion of the chair sheet material. This can support the entire body of the seated person softly, and allow only the head to lean back relative to the shoulders while supporting the head of the seated person with the extended part. Thus, the further comfortable backrest chair can be provided, which allows the seated person to sit in a relaxed way, and can softly support, in a way to wrap around, the entire body of the seated person, and can also support the head of the seated person softly.

As a chair sheet material for use on the above backrest chair of this invention, it is preferred that the core sheet and the buffer sheet are in form of flat plates, the backrest chair being constructible by attaching a lower edge of the core sheet to the chair support frame as elastically bent to follow outer peripheries of the chair support frame.

According to this chair sheet material, numerous chair sheet materials can be stacked for storage or for transport to a location for assembly with the chair support frames. While storage space can be small, the chair sheet materials can be transported efficiently to reduce transport cost. Thus, the backrest chairs can be manufactured at low cost.

Further, in the above chair sheet material, it is preferred that a cut hole is formed to penetrate the core sheet and the buffer sheet and having a length corresponding to a half of an entire circumference of a seat portion or a length longer than that and approximately corresponding to a half, the backrest chair being constructible by attaching the cut hole as being fitted on the chair support frame.

According to this chair sheet material, the chair sheet material is attachable to the chair support frame, with the cut hole fitted on the chair support frame.

Therefore, the chair sheet material can be positioned easily relative to the chair support frame by locating the cut hole of the chair sheet material over the entire circumference of the chair support frame. Thus, the chair sheet material is simply attached to the chair support frame to assemble the chair easily, thereby providing the comfortable backrest chair at low cost.

A different backrest chair of this invention is characterized in that a core sheet is provided with a shape retaining material made capable of elastic bending deformation by a high-strength carbon fiber sheet, to have an elastic resilience for assuming a backrest shape in a natural state and to be elastically displaceable while maintaining a backrest state by a stretching force in a use situation; that a chair sheet material is formed by providing a buffer sheet to cover a surface of the core sheet which is in the use situation on a back side of a seated person in a seated position; that a right and left width of a backrest portion of the chair sheet material is made larger than a breadth of the seated person's shoulders, and when a load of the seated person is applied to the backrest portion of the chair sheet material, right and left opposite ends of the backrest portion of the chair sheet material can be displaced in directions to approach each other due to elasticity of the core sheet; and that the chair sheet material is attached to a chair support frame lower than a seat surface in a state of positioning the core sheet and the buffer sheet on the back and the rear surface of the head of the seated person.

The backrest chair of this invention has been made based on findings that a high-strength carbon fiber sheet having sufficient elastic resilience, though highly strong, can be obtained by impregnating the high-strength carbon fiber sheet with an adhesive resin.

That is, according to the backrest chair of this invention, the core sheet is formed of a shape retaining material made capable of elastic bending deformation by a high-strength carbon fiber sheet, the chair sheet material is formed of the core sheet and a buffer sheet, and the chair sheet material is attached to the chair support frame lower than the seat surface to make the backrest chair. This construction assumes a backrest shape in a natural state, and in a use situation, that is when a seated person applies a load to the backrest, on the other hand, can make elastic displacement while maintaining a backrest state due to the stretching force of the shape retaining material per se. Moreover, the right and left width of the backrest portion of the chair sheet material is made larger than the breadth of the seated person's shoulders, and when the load of the seated person is applied to the backrest portion of the chair sheet material, right and left opposite ends of the backrest portion of the chair sheet material can be displaced in directions to approach each other due to the elasticity of the core sheet. This can support, in a way to wrap around, the body of the seated person.

Therefore, the entire backrest is not formed of frame members of high rigidity with large strength as in the prior art. When the seated person applies a load, the backrest is elastically displaced while maintaining a backrest state, and when the load of the seated person is applied to the backrest portion of the chair sheet material, the right and left opposite ends of the backrest portion of the chair sheet material are displaced in directions to approach each other due to the elasticity of the core sheet. This can softly support, in a way to wrap around, the entire body of the seated person. Thus, the comfortable backrest chair can be provided, which allows the seated person to sit in a relaxed way, and can softly support, in a way to wrap around, the entire body of the seated person.

In the backrest chair of the invention also, it is preferred that an upper part of the backrest portion of the chair sheet material is extended to be capable of supporting the head of the seated person, and when a load of the head of the seated person is applied to the extended part, the extended part can bend and move further rearward than the backrest portion of the chair sheet material due to the elasticity of the core sheet. This is because, as noted hereinbefore, the further comfortable backrest chair can be provided, which allows the seated person to sit in a relaxed way, and can softly support, in a way to wrap around, the entire body of the seated person, and can also support the head of the seated person softly.

As a chair sheet material for use on the above backrest chair of this invention, it is preferred that the core sheet having the shape retaining material made capable of elastic bending deformation by the high-strength carbon fiber sheet, and the buffer sheet, are in form of flat plates, the backrest chair being constructible by attaching a lower edge of the core sheet to the chair support frame as elastically bent to follow outer peripheries of the chair support frame.

According to this chair sheet material, numerous chair sheet materials can be stacked for storage or for transport to a location for assembly with the chair support frames. While storage space can be small, the chair sheet materials can be transported efficiently to reduce transport cost. Thus, the backrest chairs can be manufactured at low cost. Further, since the core sheet, with the shape retaining material formed of the high-strength carbon fiber sheet, can be made lightweight, and is easy to handle and easy to manufacture.

Further, in the above chair sheet material, it is preferred that a cut hole is formed to penetrate the core sheet and the buffer sheet and having a length corresponding to a half of an entire circumference of a seat portion or a length longer than that and approximately corresponding to a half, the backrest chair being constructible by attaching the cut hole as being fitted on the chair support frame.

According to this chair sheet material, the chair sheet material is attachable to the chair support frame, with the cut hole fitted on the chair support frame.

Therefore, the chair sheet material can be positioned easily relative to the chair support frame by locating the cut hole of the chair sheet material over the entire circumference of the chair support frame. Thus, the chair sheet material is simply attached to the chair support frame to assemble the chair easily, thereby providing the comfortable backrest chair at low cost.

Effects of the Invention

According to the construction of the backrest chair of this invention, the core sheet is formed of mesh sheets and a shape retaining material both capable of elastic bending deformation, the chair sheet material is formed of the core sheet and a buffer sheet, and the chair sheet material is attached to the chair support frame lower than the seat surface to make the backrest chair. This construction assumes a backrest shape in a natural state, and in a use situation, that is when a seated person applies a load to the backrest, on the other hand, can make elastic displacement while maintaining a backrest state due to the mesh sheets and shape retaining material per se and a mutual stretching force. Moreover, the extended part extended upward of the backrest portion of the chair sheet material for supporting the head of the seated person, when the load of the head of the seated person is applied, can bend and move further rearward than the backrest portion of the chair sheet material due to the elasticity of the core sheet. Thus, while supporting the head of the seated person, only the head can be made to lean back relative to the shoulders.

Therefore, the entire backrest is not formed of frame members of high rigidity with large strength as in the prior art. When the seated person applies a load, the backrest is elastically displaced while maintaining a backrest state, and when the load of the head of the seated person is applied, the extended part is bent further rearward than the backrest portion of the chair sheet material. This can support the entire body of the seated person softly, and allow only the head to lean back relative to the shoulders while supporting the head of the seated person with the extended part. Thus, the comfortable backrest chair can be provided, which allows the seated person to sit in a relaxed way, with the entire body including the head supported softly.

MODES FOR CARRYING OUT THE INVENTION

Next, embodiments of this invention will be described with reference to the drawings.

Embodiment 1

Figure 1:
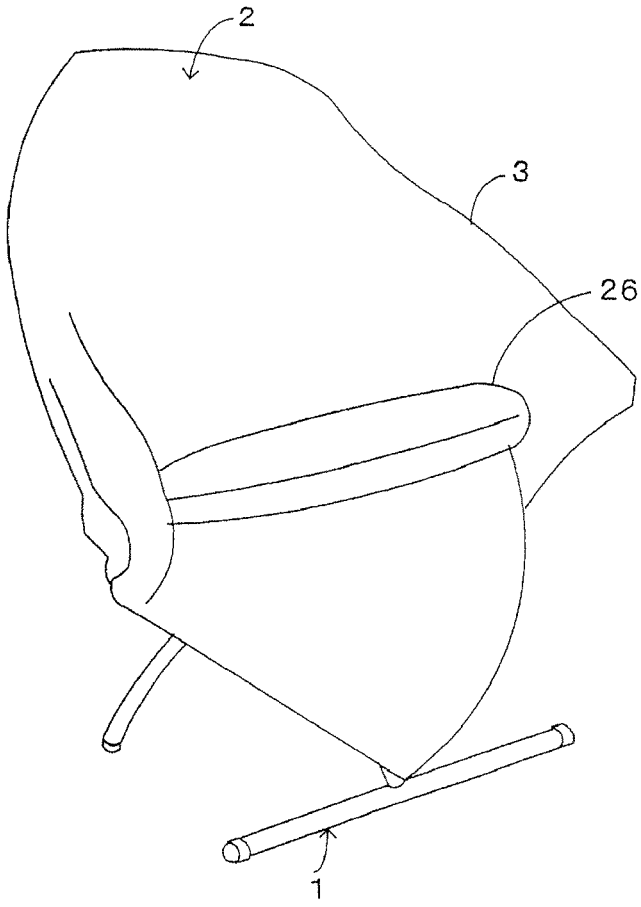
FIG. 1 is an overall perspective view showing Embodiment 1 of a backrest chair according to this invention.

FIG. 1 is an overall perspective view showing Embodiment 1 of a backrest chair according to this invention. The backrest chair is constructed of a chair support frame 1 lower than a seat surface and has, attached thereto, a chair sheet material 3 with a backrest portion 2.

Figure 2:
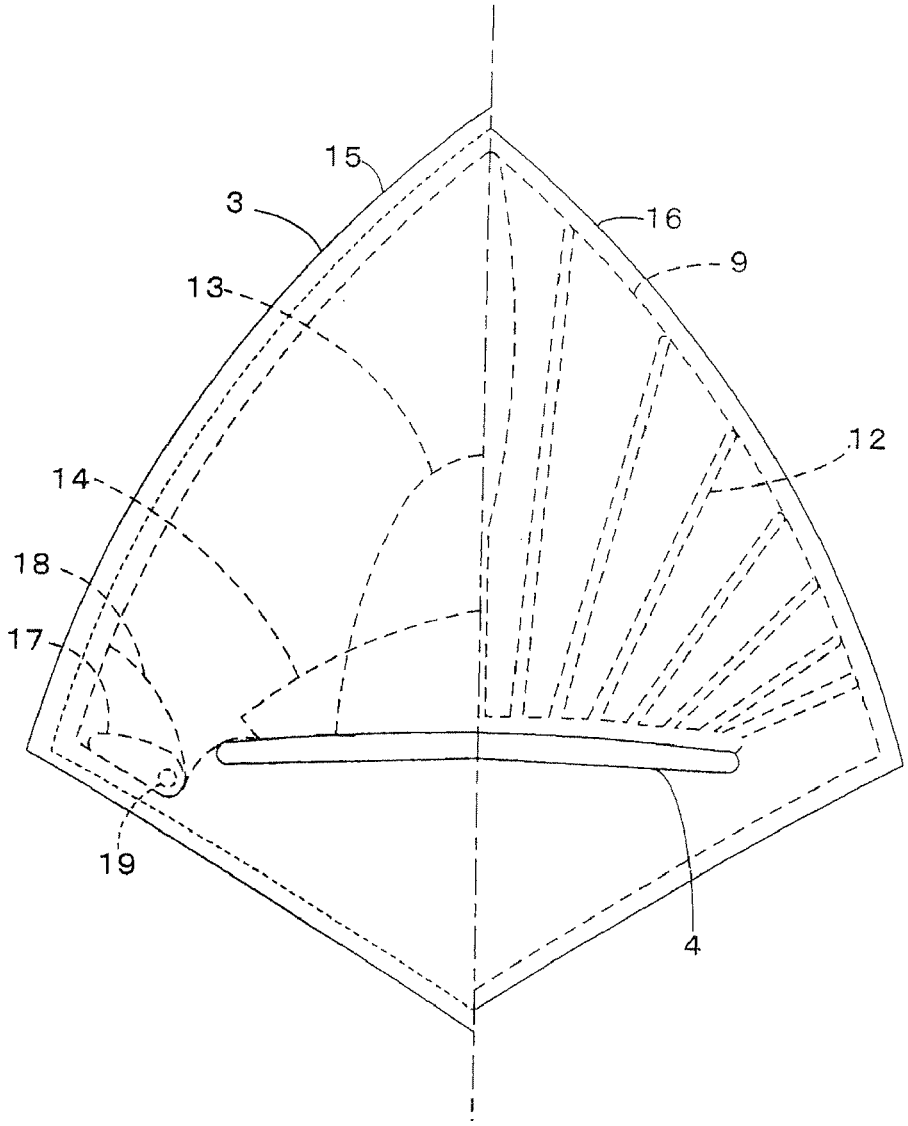
FIG. 2 is a front view, partly in section, of a chair sheet material.

The chair sheet material 3, as shown in the front view, partly in section, of the chair sheet material of FIG. 2, is formed to have a generally square shape with a projecting upper portion. An elliptical cut hole 4 is formed to penetrate the chair sheet material 3, in a position on a virtual line linking right and left apex angles or substantially parallel thereto, and having a length corresponding to a half of an entire circumference of a seat portion of the chair or a length longer than that and approximately corresponding to a half. The chair sheet material 3 is attached with the cut hole 4 fitted on the chair support frame 1.

Figure 3:
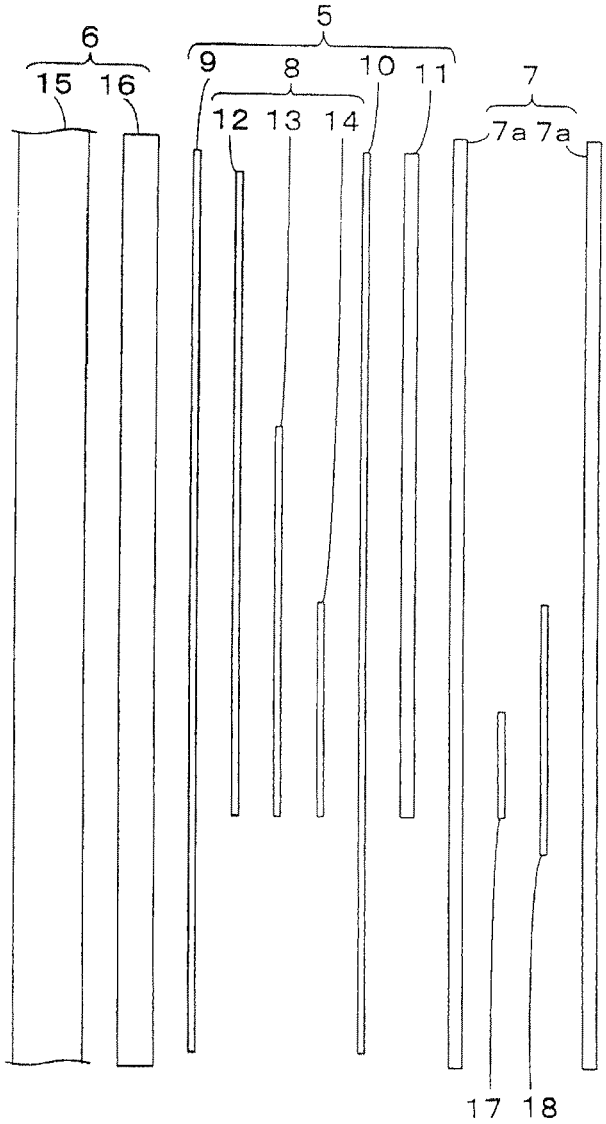
FIG. 3 is a schematic view showing, as separated, components of the chair sheet material.

FIG. 3 is a schematic view showing, as separated, components of the chair sheet material (FIG. 3 showing an arrangement relationship of the components, and not showing correct ratios between thicknesses or vertical lengths of the respective components). The chair sheet material 3 includes a core sheet 5, and a back side buffer sheet 6 and an outer surface side buffer sheet 7 covering, respectively, a surface which is in a use situation on the back side of a seated person in a seated position, and a surface opposite therefrom, of the core sheet 5.

The core sheet 5 has, attached to a shape retaining material 8, a first mesh sheet 9 on a surface thereof which is in a use situation on the back side of the seated person in the seated position, and a second and a third mesh sheets 10 and 11 on a surface opposite therefrom.

The shape retaining material 8 is formed of radial cores 12 distributed and radially extending upward from a base plate adjacent the cut hole 4, and a first and a second reinforcing cores 13 and 14 arranged adjacent the base plate of the radial cores 12 to increase supporting strength for the waist portion of the seated person.

Figure 4:
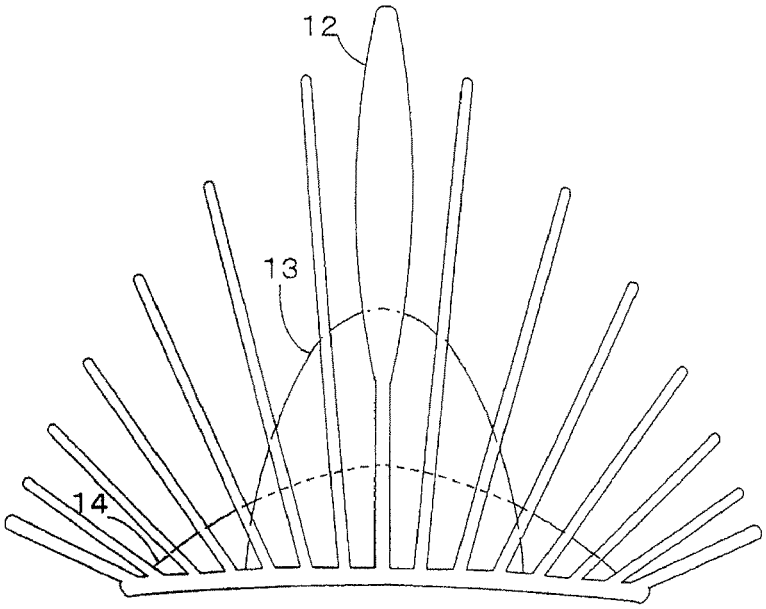
FIG. 4 is a front view of a shape retaining material.

The radial cores 12, as shown in the front view of the shape retaining material of FIG. 4, are formed radially by cutting a thin (e.g. 0.3 mm) stainless steel plate, in a state of leaving the base plate for connection to the chair support frame 1, making the width of those at right and left opposite ends larger than the others, and forming a middle one to have a slightly broad width adjacent the base plate and a large-width portion toward a distal end thereof. Each of the distal end portions of the radial cores 12 is formed to have a smooth circular shape in front view.

The first reinforcing core 13 is formed by meshing (e.g. 5 mm mesh size) galvanized steel cords of thin diameter (e.g. 0.7 mm) coated with zinc, and covering and protecting cut ends of the net at outer peripheral edges with tapes.

The second reinforcing core 14 is formed of a thin (e.g. 0.3 mm) stainless steel plate.

The radial cores 12 and first reinforcing core 13, and the first reinforcing core 13 and second reinforcing core 14, respectively, are bonded together by a synthetic rubber solvent adhesive.

With the above construction, the shape retaining material 8 is as a whole capable of elastic bending deformation.

The first mesh sheet 9 is meshed by performing polyester processing on polypropylene thread cores.

The second mesh sheet 10 is formed of polypropylene which is meshed as a grid of thin (e.g. 0.3 mm) cords 1 mm in width and with 4 mm pitch.

The third mesh sheet 11 is formed to be a mesh of tortoise shell shape, with one side of a tortoise shell portion having a length of 20 mm, and 10 mm mesh size, by using cords 2 mm thick of metal wires of 0.5 mm in diameter coated with vinyl. Here, a sheet 910 mm wide has been cut to a predetermined shape for use.

The first mesh sheet 9 and shape retaining material 8, the shape retaining material 8 and second mesh sheet 10, and the second mesh sheet 10 and third mesh sheet 11, respectively, are bonded together by the synthetic rubber solvent adhesive.

With the above construction, the core sheet 5 has an elastic resilience to assume a backrest shape in a natural state, and in a use situation is elastically displaceable by a stretching force while maintaining a backrest state.

The back side buffer sheet 6 includes a first buffer sheet 15 which is thick (e.g. 20 mm) and formed of urethane, and a second buffer sheet 16 of chip urethane having about half the thickness of the first buffer sheet 15. The first buffer sheet 15 and second buffer sheet 16 are bonded by the synthetic rubber solvent adhesive, and the second buffer sheet 16 and first mesh sheet 9 are bonded by the synthetic rubber solvent adhesive.

The outer surface side buffer sheet 7 includes two overlapping nonwoven fabrics 7*a* made into sheet form (e.g. 3 mm thick) and needlepunched together.

Outer peripheries of the first buffer sheet 15 are folded back outward, and edges thereof are joined such as by sewing to the outer surface side buffer sheet 7.

In a location corresponding to each elbow portion in a use situation of the chair sheet material 3, a first and a second elbow portion reinforcing cores 17 and 18 bonded by the synthetic rubber solvent adhesive are interposed between the two nonwoven fabrics 7*a* and 7*a* of the outer surface side buffer sheet 7.

The first elbow portion reinforcing core 17 is formed of a thin (e.g. 0.3 mm) stainless steel plate to be capable of elastic bending deformation while having a predetermined strength. A mounting hole 19 is formed in one end region thereof for attachment to the chair support frame 1.

The second elbow portion reinforcing core 18 is formed by meshing (e.g. 5 mm mesh size) galvanized steel cords of thin diameter (e.g. 0.7 mm) coated with zinc, and covering and protecting cut ends of the net at outer peripheral edges with tapes.

By interposing the above first and second elbow portion reinforcing cores 17 and 18, when loads are applied from the seated person's elbows to the elbow portions of the chair sheet material 3, the whole construction, while receiving the loads acting on the elbow portions in directions perpendicular to the direction in which a load acts on the backrest portion 2 of the chair sheet material 3, can be displaced in right and left directions with the elasticity of the first elbow portion reinforcing cores 17 in response to the loads on the elbow portions.

Figure 5:
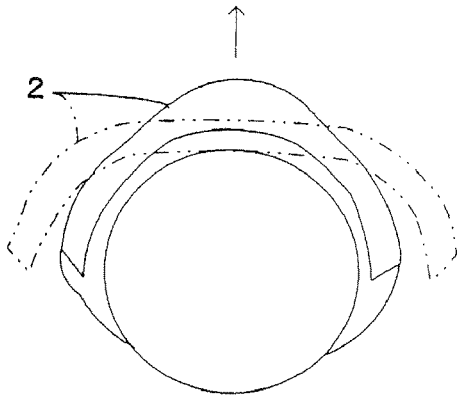
FIG. 5 is an overall plan view of the backrest chair.

The backrest portion 2 of the chair sheet material 3 is constructed to have a larger right and left width than the breadth of a seated person's shoulders (which is based on standard proportions, however, for the lean type, obese type and different physiques, what is suited to each may be considered). Combined with the construction of the above core sheet 5, as shown in the plan view of FIG. 5, when the load of the seated person is applied to the backrest portion 2 of the chair sheet material 3, the right and left opposite ends of the backrest portion 2 of the chair sheet material 3 can be displaced in directions to approach each other due to the elasticity of the core sheet 5.

Figure 6:
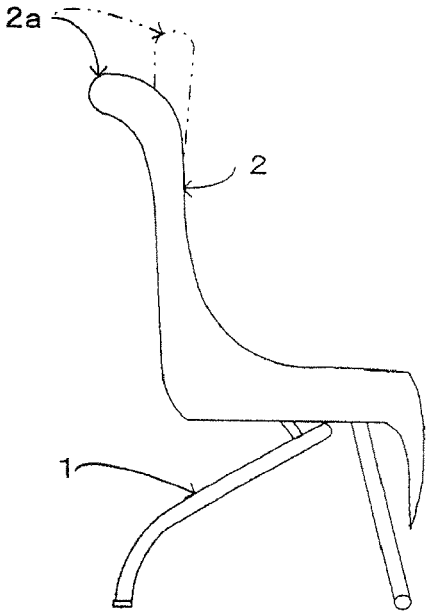
FIG. 6 is an overall side view of the backrest chair.

An upper part of the backrest portion 2 of the chair sheet material 3 is extended to be capable of supporting the head of the seated person. Combined with the construction of the above core sheet 5, as shown in the side view of FIG. 6, when the load of the head of the seated person is applied to an extended part 2*a*, the extended part 2*a* can bend and move further rearward than the backrest portion of the chair sheet material 3 due to the elasticity of the core sheet 5.

The respective components of the chair sheet material 3 are all in form of flat plates, and the chair sheet material 3 is constructed in form of a flat plate. Numerous chair sheet materials 3 can be stacked for storage or for transport to a location for assembly with the chair support frames 1. While storage space can be small, the chair sheet materials 3 can be transported efficiently to reduce transport cost. Thus, the backrest chairs can be manufactured at low cost.

Figure 7:
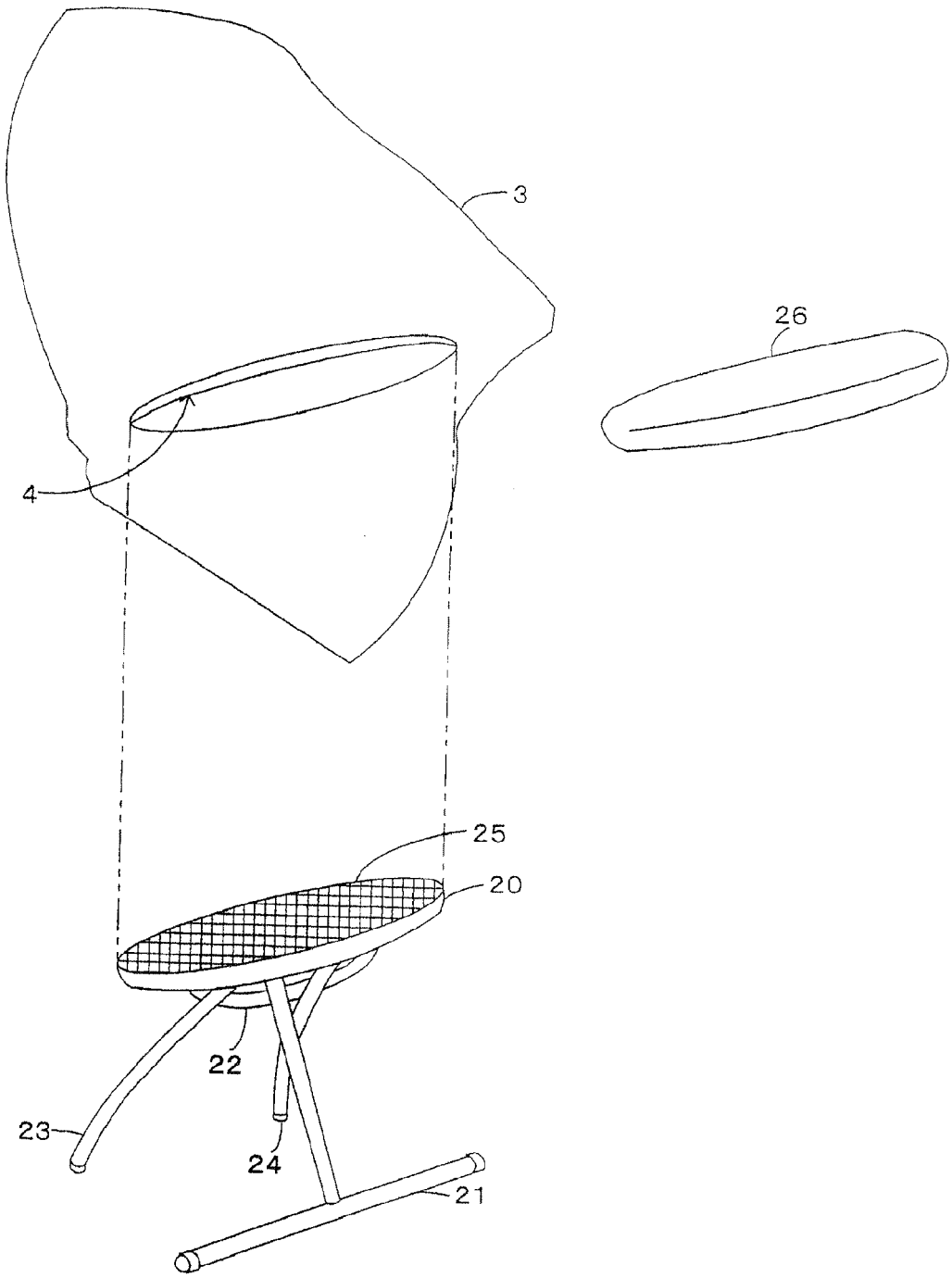
FIG. 7 is an exploded perspective view showing an assembled construction.

The chair support frame 1 is constructed as shown in the exploded perspective view of FIG. 7.

That is, a first leg frame 21 of inverted T-shape is rigidly attached by welding to a peripheral portion of an annular pipe 20 forming an upper plane which provides a seat surface for a seated person. A downwardly arc-shaped reinforcing pipe 22 is rigidly attached by welding to a central part of the annular pipe 20. A second and a third leg frames 23 and 24 are provided, each having one end rigidly attached by welding to the annular pipe 20 and an intermediate part under the reinforcing pipe 22, and extending downward. A reticulated seat portion 25 is attached to the annular pipe 20.

In assembly, the chair sheet material 3 is deformed to make the cut hole 4 circular, the cut hole 4 is fitted on the annular pipe 20, and the base plate of the radial cores 12, the first elbow portion reinforcing cores 17 and so on are rigidly connected and fixed to the annular pipe 20. The above connections can be made through various devices such annealing wire, screws, and bolts and nuts.

Subsequently, a cushion 26 is placed on the seat portion 25.

Embodiment 2

Figure 8:
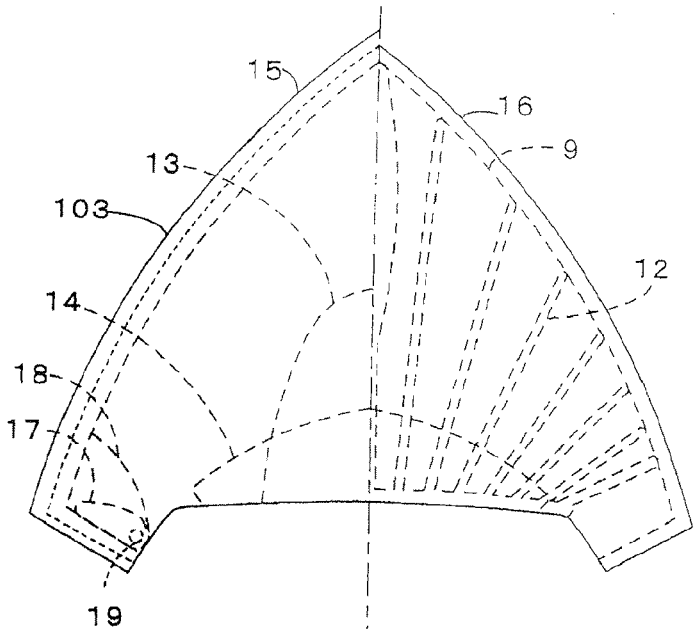
FIG. 8 (*a*) is a front view, partly in section, of a chair sheet material in Embodiment 2 of a backrest chair according to this invention, and (b) is an exploded perspective view of Embodiment 2.
Figure 8:
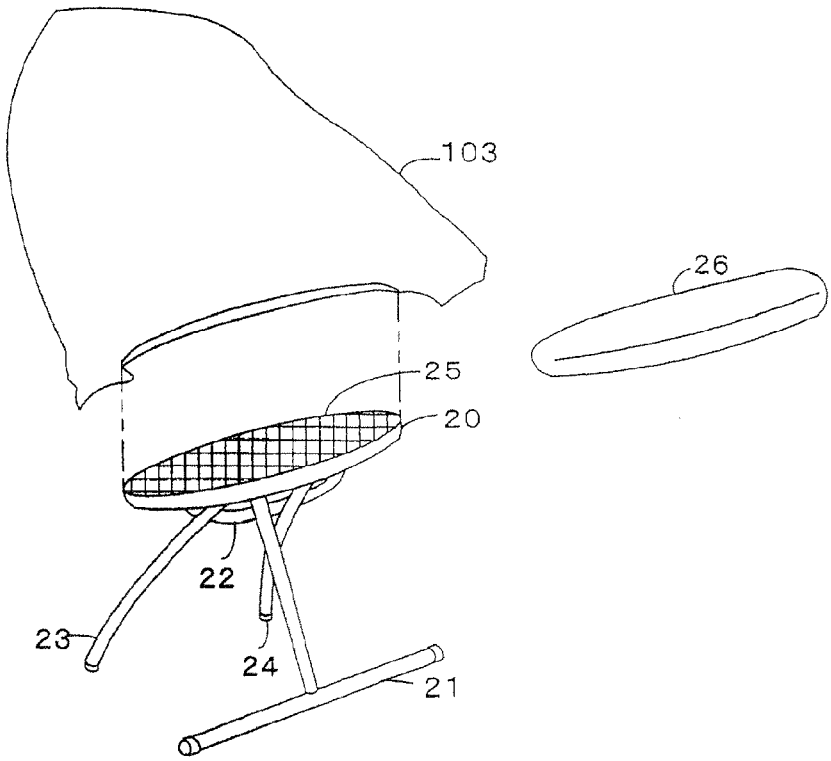

FIG. 8 (*a*) is a front view, partly in section, of a chair sheet material in Embodiment 2 of a backrest chair according to this invention, and (b) is an exploded perspective view of Embodiment 2. A difference from Embodiment 1 is as follows.

That is, a chair sheet material 103 is formed without a portion below the cut hole 4 of Embodiment 1. The other elements are the same as in Embodiment 1. Like reference numerals are affixed thereto and their description is omitted.

With this chair sheet material 103, the base plate of the radial cores 12 and the first elbow portion reinforcing cores 17 form the lowest end. These base plate of the radial cores 12 and first elbow portion reinforcing cores 17 are deformed into an arcuate shape, and are rigidly connected and fixed to the annular pipe 20, thereby to create a backrest chair.

In Embodiment 1 and Embodiment 2 described above, the shape retaining material 8 is formed of the radial cores 12 and the first and second reinforcing cores 13 and 14, each being formed of metal such as stainless steel plate or steel wire. Instead of forming these with rigid frame members as in the prior art, they may be formed to be elastically deformable while having required supporting strength for the seated person's waist portion. Various materials and constructions can be adopted such as, for example, carbon fiber sheets or wire rods, or glass fiber sheets or the like attached thereto as reinforcement. Although the shape retaining material 8 is formed of the three members 12, 13 and 14, the shape retaining material 8 may consist of a single member and a plurality of members, such as forming the radial cores 12 per se using a sheet whose thickness increases toward a location that supports the seated person's waist portion, for example.

In Embodiment 1 and Embodiment 2 described above, the mesh sheets include the three, first, second and third mesh sheets 9, 10 and 11 attached, which, however, may be one sheet or a plurality of sheets. A synthetic resin and metal wires may be used as the material therefor. What is necessary is a material for forming the core sheet 5 capable of elastic bending deformation, which, in cooperation with the shape retaining material 8, has an elastic resilience to assume a backrest shape in a natural state, and in a use situation is elastically displaceable by a stretching force while maintaining a backrest state.

Embodiment 3

Figure 9:
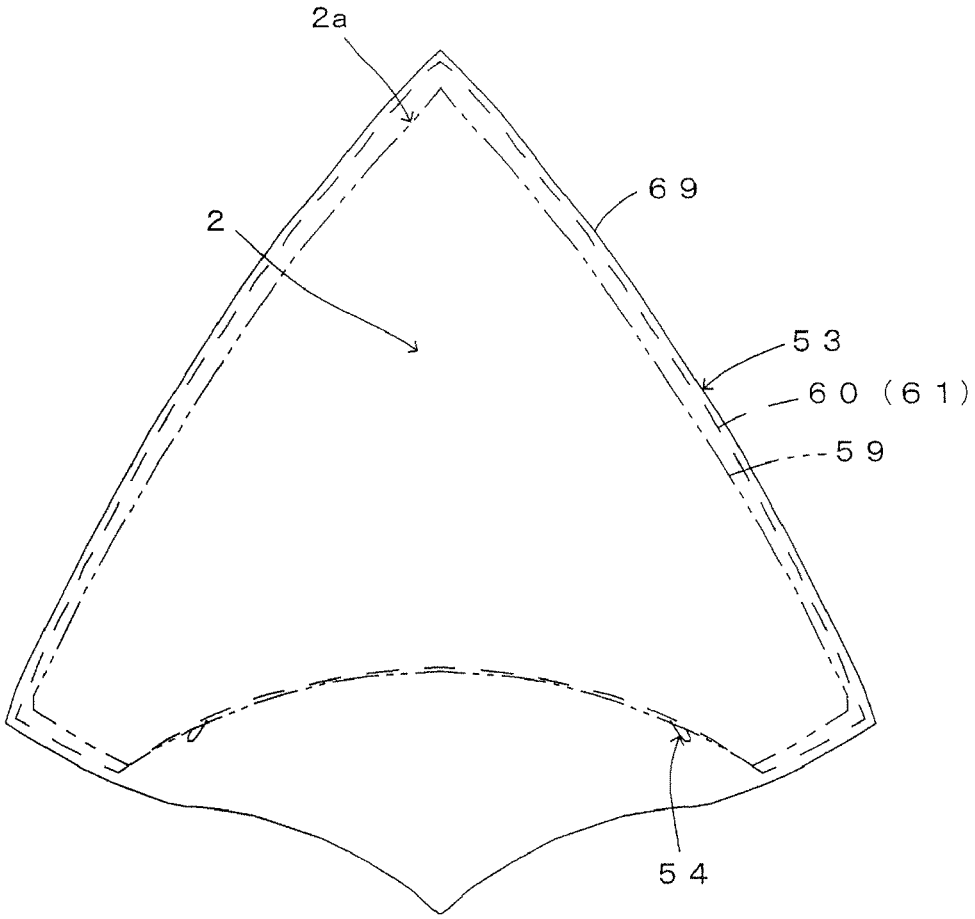
FIG. 9 is a front view of a chair sheet material in Embodiment 3 of a backrest chair according to this invention.
Figure 10:
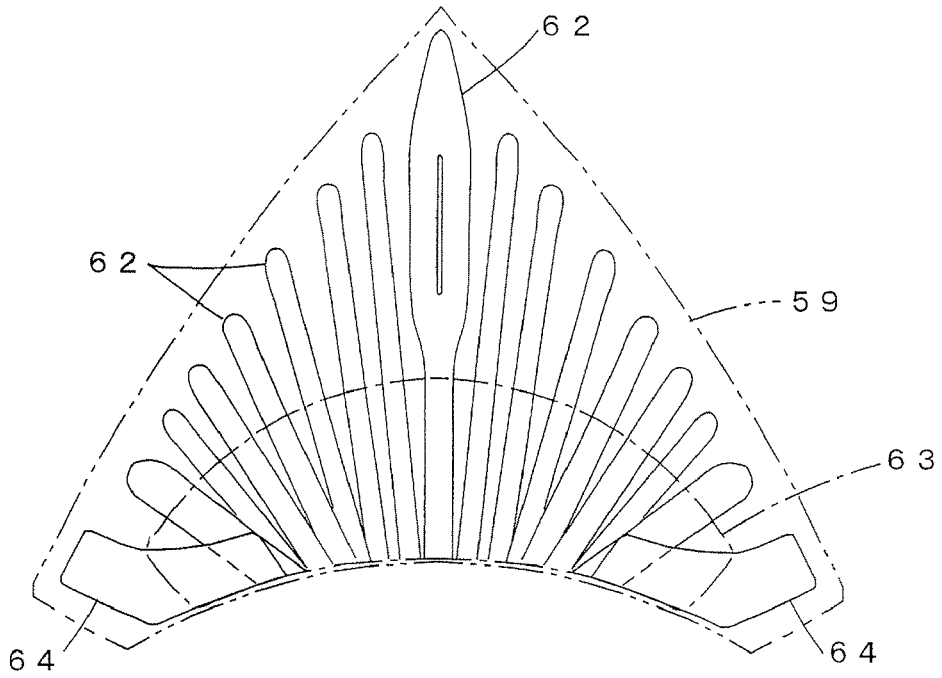
FIG. 10 is a front view, partly in section, of the chair sheet material in Embodiment 3.
Figure 11:
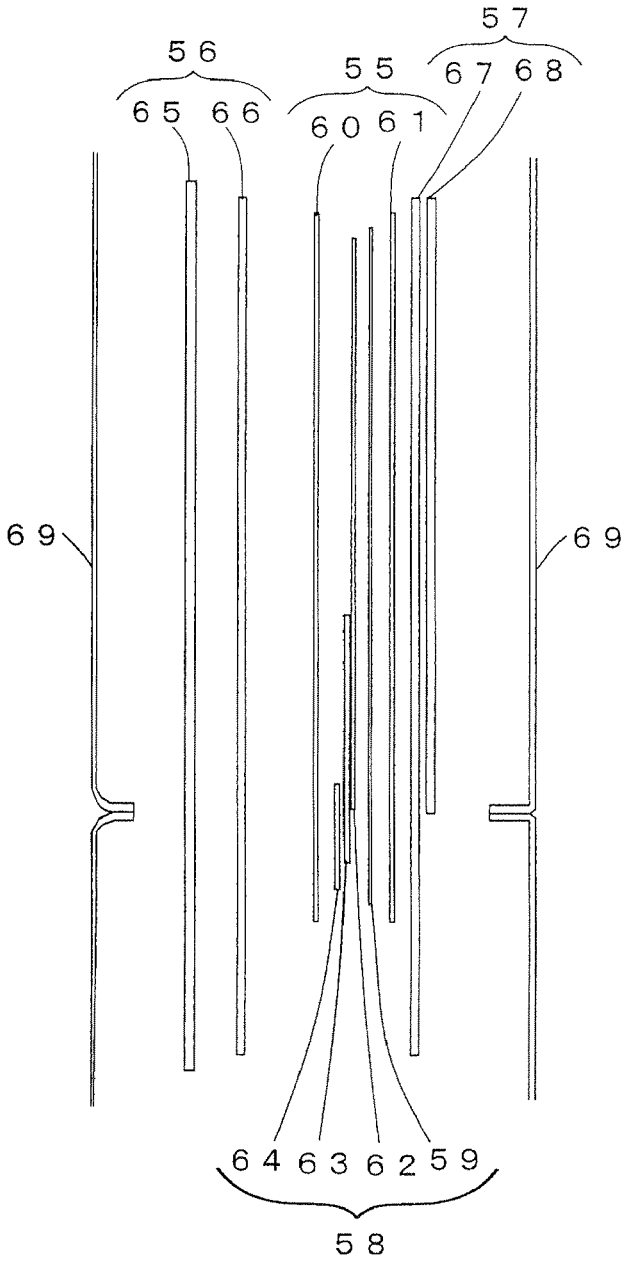
FIG. 11 is a schematic view showing, as separated, components of the chair sheet material in Embodiment 3.

FIG. 9 is a front view of a chair sheet material in Embodiment 3 of a backrest chair according to this invention. FIG. 10 is a front view, partly in section, of the chair sheet material. FIG. 11 is a schematic view showing, as separated, components of the chair sheet material (FIG. 11 showing an arrangement relationship of the components, and not showing correct ratios between thicknesses or vertical lengths of the respective components). A chair sheet material 53 is formed to have a generally square shape with a projecting upper portion.

The chair sheet material 53 has an elliptical cut hole 54 formed to penetrate it in a position on a virtual line linking right and left apex angles or substantially parallel thereto, and having a length corresponding to a half of an entire circumference of a seat portion of the chair or a length longer than that and approximately corresponding to a half. The chair sheet material 53 is attached to the chair support frame 1 with the cut hole 54 fitted on the chair support frame 1 (see FIG. 7).

The chair sheet material 53 includes a core sheet 55, and a back side buffer sheet 56 and an outer surface side buffer sheet 57 covering, respectively, a surface which is in a use situation on the back side of a seated person in the seated position, and a surface opposite therefrom, of the core sheet 55.

The core sheet 55 has a shape retaining material 58 held between a first and a second nonslip sheets 60 and 61 formed of vinyl chloride resin. In place of these first and second nonslip sheets 60 and 61, sheets such as cloths or nonwoven fabrics may be used.

The shape retaining material 58 is formed of radial cores 62 distributed and radially extending upward from a base plate adjacent the cut hole 54, and bonded to a bidirectional carbon fiber sheet 59 by double-sided adhesive tape (not shown), and a first and a second reinforcing cores 63 and 64 bonded to the radial cores 62 adjacent the base plate to increase supporting strength for the waist portion of the seated person.

The radial cores 62 and the first and second reinforcing cores 63 and 64 are each formed of a high-strength carbon fiber sheet which is given sufficient elasticity, though it is highly strong, by impregnating a thin (e.g. 0.167 mm) carbon fiber sheet using carbon fiber (weight: 300 g/m$^2$) (carbon fiber towsheet, FTS-C1-30: manufactured by Nittetsu Composite Kabushiki Kaisha) with epoxy resin (non-solvent, two-component and cold setting type, FR-E3P: manufactured by Nittetsu Composite Kabushiki Kaisha) as adhesive resin.

As the above impregnation treatment, the epoxy resin may be coated for impregnation, or the carbon fiber sheet may be immersed in a solution of epoxy resin for impregnation.

The radial cores 62 are formed radially, making the width of those at right and left opposite ends larger than the others, and forming a middle one to have a slightly broad width adjacent the base plate and a large-width portion toward a distal end thereof. Each of the distal end portions of the radial cores 62 is formed to have a smooth semicircular shape in front view.

Each of the radial cores 62 and the first and second reinforcing cores 63 and 64, and the first nonslip sheet 60, and the carbon fiber sheet 59 and second nonslip sheet 61, are bonded by the synthetic rubber solvent adhesive.

With the above construction, the shape retaining material 58 is as a whole capable of elastic bending deformation.

Each of the first and second nonslip sheets 60 and 61 has outer peripheral seal portions formed of polyester resin having polypropylene thread cores.

Outer peripheral edges of each of the first and second nonslip sheets 60 and 61 are integrated with a third buffer sheet 67, which forms the outer surface side buffer sheet 57 to be described hereinafter, by machine sewing or hand sewing, to cover the entire shape retaining material 58, thereby to prevent the shape retaining material 58 from projecting outward, and prevent sound from coming outside when the carbon fiber sheet 59 is moved by body pressure.

With the above construction, the core sheet 55 has an elastic resilience to assume a backrest shape in a natural state, and in a use situation is elastically displaceable by a stretching force while maintaining a backrest state.

The back side buffer sheet 56 includes a thick (e.g. 20 mm) first buffer sheet 65 formed of urethane, and a second buffer sheet 66 of chip urethane having about half the thickness of the first buffer sheet 65. The first buffer sheet 65 and second buffer sheet 66 are bonded by the synthetic rubber solvent adhesive, and the second buffer sheet 66 and first nonslip sheet 60 are bonded by the synthetic rubber solvent adhesive.

The outer surface side buffer sheet 57 includes a third buffer sheet 67 of felt (e.g. 5 mm thick) formed of two overlapping nonwoven fabrics 7*a* made into sheet form and needlepunched together, and a fourth buffer sheet 68 of tetron cotton (e.g. 5 mm thick).

Outer peripheries of the first buffer sheet 65 are folded back outward, and edges thereof are joined such as by sewing to the fourth buffer sheet 68.

An entirety from the first buffer sheet 65 to the fourth buffer sheet 68 is covered by a facing cloth material 69. Used as this facing cloth material 69 is, for example, a cloth material having various colors and/or various patterns.

The respective components of the chair sheet material 53 are all in form of flat plates, and the chair sheet material 53 is constructed in form of a flat plate. Numerous chair sheet materials 53 can be stacked for storage or for transport to a location for assembly with the chair support frames 1. While storage space can be small, the chair sheet materials 53 can be transported efficiently to reduce transport cost. Thus, the backrest chairs can be manufactured at low cost.

In a use situation with the chair sheet material 53 assembled to the chair support frame 1, distal portions of the second reinforcing cores 64 are arranged in locations corresponding to the respective elbow portions. When loads are applied from the seated person's elbows to the elbow portions of the chair sheet material 53, the whole construction, while receiving the loads acting on the elbow portions in directions perpendicular to the direction in which a load acts on the backrest portion 2 of the chair sheet material 53, can be displaced in right and left directions in response to the loads on the elbow portions.

The other elements are the same as in Embodiment 1. Combined with the construction of the above core sheet 55, when the load of the seated person is applied to the backrest portion 2 of the chair sheet material 53, the right and left opposite ends of the backrest portion 2 of the chair sheet material 3 can be displaced in directions to approach each other due to the elasticity of the core sheet 55, thereby to support, in a way to wrap around, the body of the seated person.

An upper part of the backrest portion 2 of the chair sheet material 53 is extended to be capable of supporting the head of the seated person. Combined with the construction of the above core sheet 55, when the load of the head of the seated person is applied to an extended part 2*a*, the extended part 2*a* can bend and move further rearward than the backrest portion of the chair sheet material 53 due to the elasticity of the core sheet 55.

Embodiment 4

Figure 12:
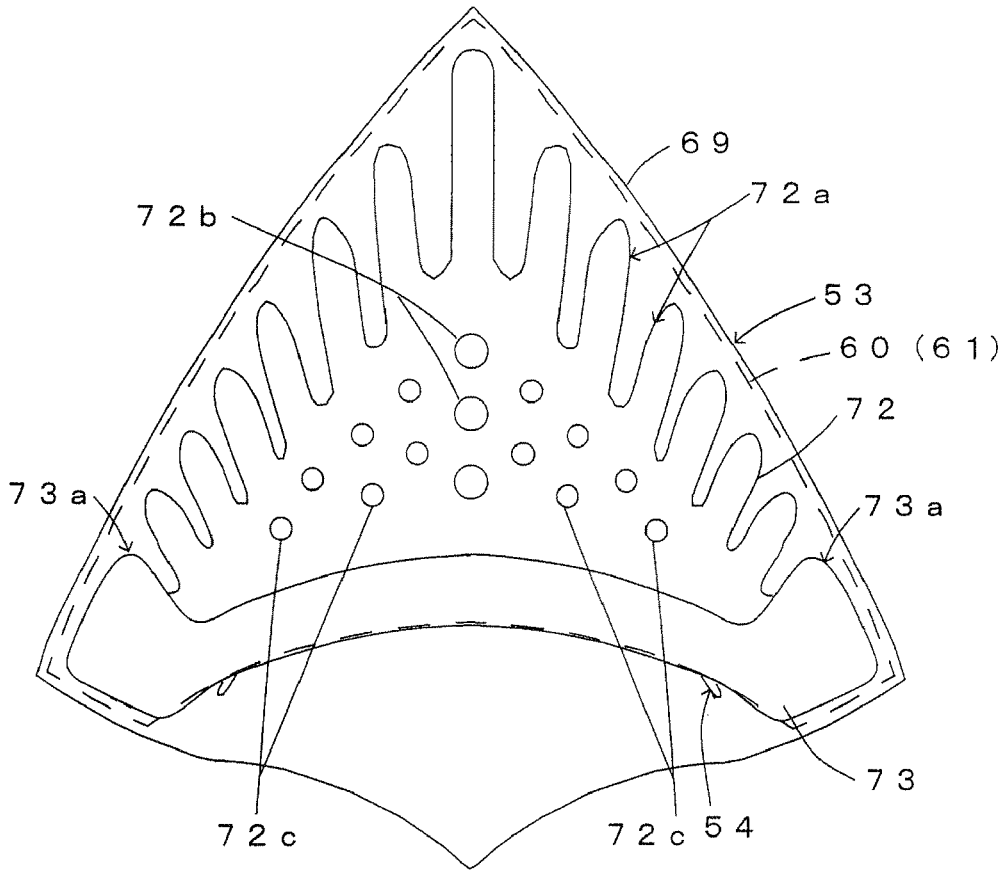
FIG. 12 is a front view, partly in section, of a chair sheet material in Embodiment 4 of a backrest chair according to this invention.
Figure 13:
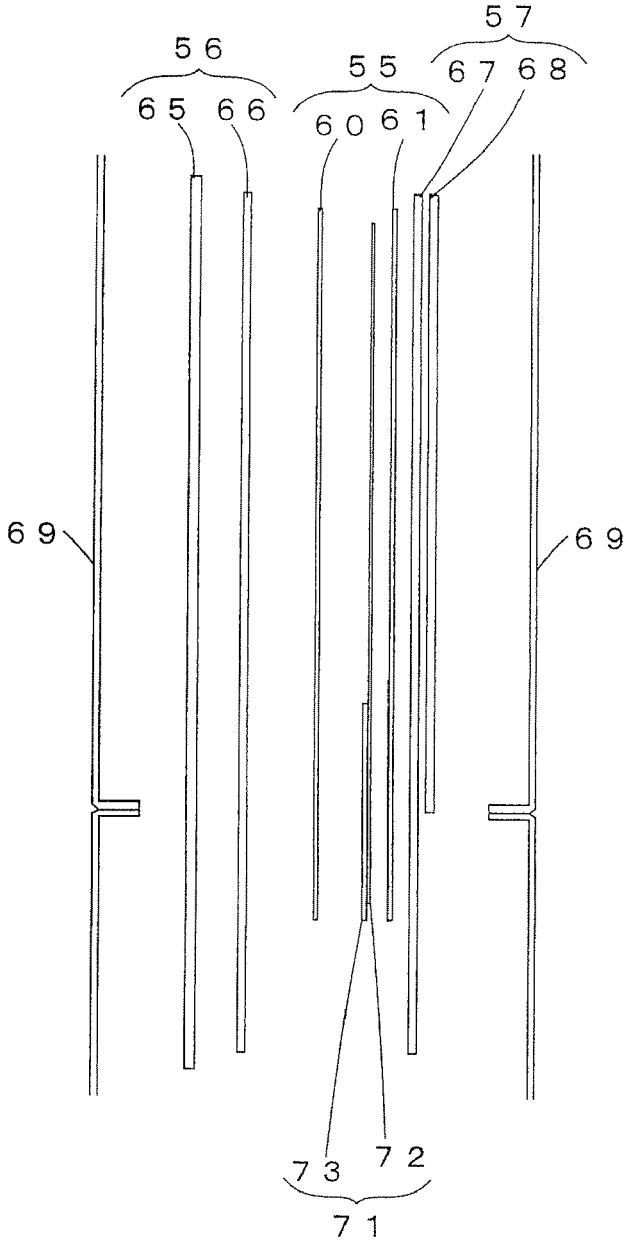
FIG. 13 is a schematic view showing, as separated, components of the chair sheet material in Embodiment 4.

FIG. 12 is a front view of a chair sheet material in Embodiment 4 of a backrest chair according to this invention. FIG. 13 is a schematic view showing, as separated, components of the chair sheet material (FIG. 13 showing an arrangement relationship of the components, and not showing correct ratios between thicknesses or vertical lengths of the respective components). This provides an improvement upon the core sheet 55 in Embodiment 3, as described hereinafter.

That is, a shape retaining material 71, which replaces the shape retaining material 58 of Embodiment 3, is formed of a one-piece, flat carbon fiber sheet 72 with a reinforcing carbon fiber sheet 73 bonded thereto by the synthetic rubber solvent adhesive.

The carbon fiber sheet 72 has radial portions 72*a* on an upper end region thereof, first holes 72*b* of large diameter formed in a central part, and second holes 72*c* of smaller diameter than the first holes 72*b* formed in each of opposite sides from the center.

The reinforcing carbon fiber sheet 73 is formed to have a size extending over an entire proximal end side of the carbon fiber sheet 72. The reinforcing carbon fiber sheet 73 includes a broad portion 73*a* having a vertical width in a location corresponding to each of the elbow portions.

The carbon fiber sheet 72 and the reinforcing carbon fiber sheet 73 are each formed of a high-strength carbon fiber sheet which is given sufficient elasticity, though it is highly strong, by impregnating a thin (e.g. 0.168 mm) carbon fiber sheet using bidirectional carbon fiber (weight: 300 g/m$^2$, and fiber thickness in each direction: 0.0834 mm) (carbon fiber tow-sheet, FTS-C0-30BW: manufactured by Nittetsu Composite Kabushiki Kaisha) with epoxy resin (non-solvent, two-component and cold setting type, FR-E3P: manufactured by Nittetsu Composite Kabushiki Kaisha) as adhesive resin. The other elements are the same as in Embodiment 3. Like reference numerals are affixed thereto and their description is omitted.

According to this Embodiment 4, the shape retaining material 71 can be formed of the carbon fiber sheet 72 and the reinforcing carbon fiber sheet 73, and it has an advantage over Embodiment 3 that the construction can be simplified. However, for the purpose of this invention, the shape retaining material 71 may consist of one member, such as by increasing the thickness in locations attached to the chair support frame 1.

Various materials such as metal, wood and plastic are applicable as materials for the annular pipe 20, reinforcing pipe 22, first, second and third leg frames 21, 23 and 24, respectively, constituting the chair support frame 1.

Although it is preferable to use the chair support frame 1 of this invention having a seat portion of round shape, i.e. circular in plan view, it is applicable also to a seat portion of rectangular shape such as square shape. In either case, regardless of the shape of the seat portion, the cut holes 4 and 54 may be formed to have a length half or approximately half the circumference of the seat portion so that the chair sheet materials 3 and 53 may be attached in a state of fitting on the chair support frame 1.

The radial cores 62 and the first and second reinforcing cores 63 and 64 in Embodiment 3, and the carbon fiber sheet 72 and the reinforcing carbon fiber sheet 73 in Embodiment 4, respectively, are not limited to those formed by impregnating carbon fiber sheets cut in predetermined shapes with epoxy resin. They may be formed by predetermined cutting of the carbon fiber sheets after impregnation with epoxy resin.

The carbon fiber sheet used is not limited to the weight of 300 g/m$^2$, but may have varied weights.

In the foregoing embodiments, the buffer sheets provided include the back side buffer sheets 6 and 56 and outer surface side buffer sheets 7 and 57, but only the back side sheets may be provided. The back side buffer sheets 6 and 66 are not limited to two, first and second buffer sheets 15, 16, 65 and 66, but one sheet or three or more sheets may be provided.

In this invention, the constructions of Embodiment 1, Embodiment 3 and Embodiment 4 may be reduced in vertical length, without forming the cut holes 4 and 54, like Embodiment 2 described hereinbefore. When attached to the chair support frame 1, the chair sheet materials 3 and 53 may have lower sides continuous with a vertically lower part of the backrest portion 2.

In the foregoing embodiments, in a use situation of the chair sheet materials 5 and 53, the first and second elbow portion reinforcing cores 17 and 18, the second reinforcing core 64, and the reinforcing carbon fiber sheet 73, are interposed in the locations corresponding to the respective elbow portions. When loads are applied from the seated person's elbows to the elbow portions of the chair sheet materials 3 and 53, the construction, while receiving the loads acting on the elbow portions in directions perpendicular to the direction in which a load acts on the backrest portion 2 of the chair sheet materials 3 and 53, can be displaced in right and left directions in response to the loads on the elbow portions. However, it is possible to provide a construction including no locations corresponding to the respective elbow portions in the use situation of the chair sheet materials 3 and 53.

DESCRIPTION OF REFERENCES

1 . . . chair support frame
2 . . . backrest portion
2*a* . . . extended part of the backrest portion
3, 53 . . . chair sheet material
4, 54 . . . cut hole
5, 55 . . . core sheet
6, 56 . . . back side buffer sheet (buffer sheet)
7, 57 . . . outer surface side buffer sheet (buffer sheet)
8, 58, 71 . . . shape retaining material
9 . . . first mesh sheet (mesh sheet)
10 . . . second mesh sheet (mesh sheet)
11 . . . third mesh sheet (mesh sheet)
12 . . . radial cores (shape retaining material)
13 . . . first reinforcing core (shape retaining material)
14 . . . second reinforcing core (shape retaining material)
15 . . . first buffer sheet (buffer sheet)
16 . . . second buffer sheet (buffer sheet)
59 . . . carbon fiber sheet (shape retaining material)
62 . . . radial cores (shape retaining material)
63 . . . first reinforcing core (shape retaining material)
64 . . . second reinforcing core (shape retaining material)
65 . . . first buffer sheet (buffer sheet)
66 . . . second buffer sheet (buffer sheet)
67 . . . third buffer sheet (buffer sheet)
68 . . . fourth buffer sheet (buffer sheet)
72 . . . carbon fiber sheet (shape retaining material)
73 . . . reinforcing carbon fiber sheet (shape retaining material)
103 . . . chair sheet material

The invention claimed is:

1. A backrest chair characterized in that a core sheet is formed by attaching a shape retaining material capable of elastic bending deformation to mesh sheets capable of elastic bending deformation, to have an elastic resilience for assuming a backrest shape in a natural state and to be elastically displaceable while maintaining a backrest state by a stretching force in a use situation; that a chair sheet material is formed by providing a buffer sheet to cover a surface of the core sheet which is in the use situation on a back side of a seated person in a seated position; that an upper part of a backrest portion of the chair sheet material is extended to form an extended part capable of supporting a head of the seated person, and when a load of the head of the seated person is applied to the extended part, the extended part can bend and move further rearward than the backrest portion of the chair sheet material due to elasticity of the core sheet; and that the chair sheet material is attached to a chair support frame lower than a seat surface in a state of positioning the core sheet and the buffer sheet on a back and a rear surface of the head of the seated person, and wherein the chair sheet material is characterized in that a cut hole is formed to penetrate the core sheet and the buffer sheet and having a length approximately corresponding to a half of an entire circumference of a seat portion, the backrest chair being constructible by attaching the chair sheet material to the chair support frame by fitting the cut hole on the chair support frame.

2. A chair sheet material for use on the backrest chair according to claim 1 characterized in that the core sheet and the buffer sheet are in form of flat plates, the backrest chair being constructible by attaching a lower edge of the core sheet to the chair support frame as elastically bent to follow outer peripheries of the chair support frame.

3. A backrest chair characterized in that a core sheet is formed by attaching a shape retaining material capable of elastic bending deformation to mesh sheets capable of elastic bending deformation, to have an elastic resilience for assuming a backrest shape in a natural state and to be elastically displaceable while maintaining a backrest state by a stretching force in a use situation; that a chair sheet material is formed by providing a buffer sheet to cover a surface of the core sheet which is in the use situation on a back side of a seated person in a seated position; that a right and left width of a backrest portion of the chair sheet material is made larger than a breadth of the seated person's shoulders, and when a load of the seated person is applied to the backrest portion of the chair sheet material, right and left opposite ends of the backrest portion of the chair sheet material can be displaced in directions to approach each other due to elasticity of the core sheet; and that the chair sheet material is attached to a chair support frame lower than a seat surface in a state of positioning the core sheet and the buffer sheet on a back and a rear surface of a head of the seated person, and wherein the chair sheet material is characterized in that a cut hole is formed to penetrate the core sheet and the buffer sheet and having a length approximately corresponding to a half of an entire circumference of a seat portion, the backrest chair being constructible by attaching the chair sheet material to the chair support frame by fitting the cut hole on the chair support frame.

4. The backrest chair according to claim 3 characterized in that an upper part of the backrest portion of the chair sheet material is extended to form an extended part capable of supporting the head of the seated person, and when a load of the head of the seated person is applied to the extended part, the extended part can bend and move further rearward than the backrest portion of the chair sheet material due to the elasticity of the core sheet.

5. A chair sheet material for use on the backrest chair according to claim 4 characterized in that the core sheet and the buffer sheet are in form of flat plates, the backrest chair being constructible by attaching a lower edge of the core sheet to the chair support frame as elastically bent to follow outer peripheries of the chair support frame.

6. A chair sheet material for use on the backrest chair according to claim 3 characterized in that the core sheet and the buffer sheet are in form of flat plates, the backrest chair being constructible by attaching a lower edge of the core sheet to the chair support frame as elastically bent to follow outer peripheries of the chair support frame.

7. A backrest chair characterized in that a core sheet is provided with a shape retaining material made capable of elastic bending deformation by a high-strength carbon fiber sheet, to have an elastic resilience for assuming a backrest shape in a natural state and to be elastically displaceable while maintaining a backrest state by a stretching force in a use situation; that a chair sheet material is formed by providing a buffer sheet to cover a surface of the core sheet which is in the use situation on a back side of a seated person in a seated position; that a right and left width of a backrest portion of the chair sheet material is made larger than a breadth of the seated persons shoulders, and when a load of the seated person is applied to the backrest portion of the chair sheet material, right and left opposite ends of the backrest portion of the chair sheet material can be displaced in directions to approach each other due to elasticity of the core sheet; and that the chair sheet material is attached to a chair support frame lower than a seat surface in a state of positioning the core sheet and the buffer sheet on a back and a rear surface of a head of the seated person, and wherein the chair sheet material is characterized in that a cut hole is formed to penetrate the core sheet and the buffer sheet and having a length approximately corresponding to a half of an entire circumference of a seat portion, the backrest chair being constructible by attaching the chair sheet material to the chair support frame by fitting the cut hole on the chair support frame.

8. The backrest chair according to claim 7 characterized in that an upper part of the backrest portion of the chair sheet material is extended to form an extended part capable of supporting the head of the seated person, and when a load of the head of the seated person is applied to the extended part, the extended part can bend and move further rearward than the backrest portion of the chair sheet material due to the elasticity of the core sheet.

9. A chair sheet material for use on the backrest chair according to claim 8 characterized in that the core sheet and the buffer sheet are in form of flat plates, the backrest chair being constructible by attaching a lower edge of the core sheet to the chair support frame as elastically bent to follow outer peripheries of the chair support frame.

10. A chair sheet material for use on the backrest chair according to claim 7 characterized in that the core sheet and the buffer sheet are in form of flat plates, the backrest chair being constructible by attaching a lower edge of the core sheet to the chair support frame as elastically bent to follow outer peripheries of the chair support frame.

* * * * *